US009863283B2

(12) United States Patent
Yashiki et al.

(10) Patent No.: US 9,863,283 B2
(45) Date of Patent: Jan. 9, 2018

(54) STEAM TURBINE POWER PLANT AND METHOD FOR ACTIVATING STEAM TURBINE POWER PLANT

(71) Applicant: Mitsubishi Hitachi Power Systems, Ltd., Yokohama, Kanagawa (JP)

(72) Inventors: Tatsuro Yashiki, Tokyo (JP); Yukinori Katagiri, Tokyo (JP); Takuya Yoshida, Tokyo (JP); Miyuki Kawata, Tokyo (JP); Yasuhiro Yoshida, Tokyo (JP); Eunkyeong Kim, Tokyo (JP); Kenichiro Nomura, Yokohama (JP); Kazunori Yamanaka, Yokohama (JP); Fumiyuki Suzuki, Yokohama (JP); Norihiro Iyanaga, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 458 days.

(21) Appl. No.: 14/532,253

(22) Filed: Nov. 4, 2014

(65) Prior Publication Data

US 2015/0121872 A1 May 7, 2015

(30) Foreign Application Priority Data

Nov. 5, 2013 (JP) ..... 2013-229571

(51) Int. Cl.
*F01K 13/02* (2006.01)
*F01K 7/16* (2006.01)
*F22B 35/00* (2006.01)

(52) U.S. Cl.
CPC ..... *F01K 13/02* (2013.01); *F01K 7/165* (2013.01); *F22B 35/00* (2013.01); *F05D 2260/821* (2013.01)

(58) Field of Classification Search
CPC . F01K 7/165; F01K 13/02; F01K 3/22; F01D 19/00; F01D 19/02; F01D 21/00;
(Continued)

(56) References Cited

U.S. PATENT DOCUMENTS 4,228,359 A 10/1980 Matsumoto et al.
4,651,533 A 3/1987 Ura et al.
(Continued)

FOREIGN PATENT DOCUMENTS

JP 7-217407 A 8/1995
JP 2009-281248 A 12/2009

OTHER PUBLICATIONS

Extended European Search Report dated Apr. 13, 2015 (five (5) pages).

*Primary Examiner* — Mark Laurenzi
*Assistant Examiner* — Mickey France
(74) *Attorney, Agent, or Firm* — Crowell & Moring LLP

(57) ABSTRACT

A steam turbine power plant includes a life consumption amount calculator configured to calculate life consumption amounts of a turbine rotor based on a value measured by a measurer, a thermal stress limit update timing determining device configured to determine a time when thermal stress limits are updated, an accumulated life consumption amount calculator configured to calculate accumulated life consumption amounts of the turbine rotor when the thermal stress limits are updated, a planned life consumption amount setting device configured to set planned life consumption amounts of the turbine rotor based on the accumulated life consumption amounts of the turbine rotor, a thermal stress limit calculator configured to calculate and update the thermal stress limits based on the planned life consumption amounts of the turbine rotor, and a plant command value
(Continued)

calculator configured to calculate a plant command value based on the thermal stress limits.

6 Claims, 12 Drawing Sheets

(58) Field of Classification Search
CPC ..... F01D 21/003; F01D 21/04; F01D 21/045; F01D 21/06; F01D 21/08; F01D 21/12; F01D 21/14; F01D 21/20
USPC ..... 60/646, 652, 656, 657, 658, 660, 670
See application file for complete search history.

(56) References Cited

U.S. PATENT DOCUMENTS

| | | | |
|---|---|---|---|
| 4,841,918 | A | 6/1989 | Fukayama et al. |
| 4,888,953 | A | 12/1989 | Fukayama et al. |
| 2009/0288416 | A1 | 11/2009 | Matsumoto et al. |
| 2013/0047613 | A1 | 2/2013 | Holt et al. |

FIG.4

| ACTIVATION MODE | | | | HOT START | WARM START | COLD START | |
|---|---|---|---|---|---|---|---|
| NUMBER OF TIMES OF ACTIVATION FOR ONE YEAR | | | | 100 | 15 | 2 | 50 |
| PREVIOUS TIME PERIOD | LIFE CONSUMPTION AMOUNTS (%) | ACCUMULATED AMOUNT (FOR 2 YEARS) | | 1. 842 | 1. 628 | 0. 424 | 51 |
| | | PLANNED AMOUNTS | AMOUNT FOR 2 YEARS | 2. 334 | 2. 334 | 0. 334 | 52 |
| | | | AMOUNT FOR ONE TIME OF ACTIVATION | 0. 012 | 0. 078 | 0. 083 | 53 |
| | | DEVIATION (FOR 2 YEARS) | | 0. 492 | 0. 706 | −0. 090 | 54 |
| CURRENT TIME PERIOD | LIFE CONSUMPTION AMOUNTS (%) | PLANNED AMOUNTS | AMOUNT FOR 2 YEARS | 2. 826 | 3. 040 | 0. 244 | 55 |
| | | | AMOUNT FOR ONE TIME OF ACTIVATION | 0. 014 | 0. 101 | 0. 061 | 56 |

FIG.7

| ACTIVATION MODE | | | | HOT START | WARM START | COLD START | |
|---|---|---|---|---|---|---|---|
| NUMBER OF TIMES OF ACTIVATION FOR ONE YEAR | | | | 100 | 15 | 2 | 50 |
| PREVIOUS TIME PERIOD | LIFE CONSUMPTION AMOUNTS (%) | ACCUMULATED AMOUNT (FOR 2 YEARS) | | 1. 842 | 1. 628 | 0. 424 | 51 |
| PREVIOUS TIME PERIOD | LIFE CONSUMPTION AMOUNTS (%) | PLANNED AMOUNTS | AMOUNT FOR 2 YEARS | 2. 334 | 2. 334 | 0. 334 | 52 |
| PREVIOUS TIME PERIOD | LIFE CONSUMPTION AMOUNTS (%) | PLANNED AMOUNTS | AMOUNT FOR ONE TIME OF ACTIVATION | 0. 012 | 0. 078 | 0. 083 | 53 |
| PREVIOUS TIME PERIOD | LIFE CONSUMPTION AMOUNTS (%) | DEVIATION (FOR 2 YEARS) | | 0. 492 | 0. 706 | −0. 090 | 54 |
| CURRENT TIME PERIOD | DEVIATION ASSIGNMENT RATIO | | | 0. 0 | 1. 0 | 0. 0 | 150 |
| CURRENT TIME PERIOD | DEVIATION ASSIGNMENT VALUE | | | 0. 000 | 1. 197 | −0. 090 | 151 |
| CURRENT TIME PERIOD | LIFE CONSUMPTION AMOUNTS (%) | PLANNED AMOUNTS | AMOUNT FOR 2 YEARS | 2. 334 | 3. 531 | 0. 244 | 55 |
| CURRENT TIME PERIOD | LIFE CONSUMPTION AMOUNTS (%) | PLANNED AMOUNTS | AMOUNT FOR ONE TIME OF ACTIVATION | 0. 012 | 0. 118 | 0. 061 | 56 |

FIG.10

| ACTIVATION MODE | | | | HOT START | WARM START | COLD START | |
|---|---|---|---|---|---|---|---|
| PREVIOUS TIME PERIOD | NUMBER OF TIMES OF ACTIVATION FOR ONE YEAR | | | 100 | 15 | 2 | 50 |
| | LIFE CONSUMPTION AMOUNTS (%) | ACCUMULATED AMOUNT (FOR 2 YEARS) | | 1. 842 | 1. 628 | 0. 424 | 51 |
| | | PLANNED AMOUNTS | AMOUNT FOR 2 YEARS | 2. 334 | 2. 334 | 0. 334 | 52 |
| | | | AMOUNT FOR ONE TIME OF ACTIVATION | 0. 012 | 0. 078 | 0. 083 | 53 |
| | | DEVIATION (FOR 2 YEARS) | | 0. 492 | 0. 706 | −0. 090 | 54 |
| CURRENT TIME PERIOD | NUMBER OF TIMES OF ACTIVATION FOR ONE YEAR | | | 80 | 30 | 2 | 250 |
| | DEVIATION (FOR 2 YEARS) BY REDUCTION IN NUMBER OF TIMES OF ACTIVATION | | | 0. 467 | 0. 000 | 0. 000 | 252 |
| | DEVIATION ASSIGNMENT RATIO | | | 0. 0 | 1. 0 | 0. 0 | 150 |
| | DEVIATION ASSIGNMENT VALUE | | | 0. 000 | 1. 665 | −0. 090 | 251 |
| | LIFE CONSUMPTION AMOUNTS (%) | PLANNED AMOUNTS | AMOUNT FOR 2 YEARS | 1. 867 | 3. 999 | 0. 244 | 55 |
| | | | AMOUNT FOR ONE TIME OF ACTIVATION | 0. 012 | 0. 133 | 0. 061 | 56 |

FIG.12

| ACTIVATION MODE | | HOT START | WARM START | COLD START |
|---|---|---|---|---|
| NUMBER OF TIMES OF ACTIVATION FOR ONE YEAR | | 100 | 15 | 2 |
| PLANNED LIFE CONSUMPTION AMOUNTS (%) | AMOUNT FOR 30 YEARS OF PLANT OPERATION | 35 | 35 | 5 |
| | AMOUNT FOR ONE TIME OF ACTIVATION | 0.012 | 0.078 | 0.083 |

STEAM TURBINE POWER PLANT AND METHOD FOR ACTIVATING STEAM TURBINE POWER PLANT

BACKGROUND OF THE INVENTION

1. Field of the Invention

The present invention relates to a steam turbine power plant and a method for activating the steam turbine power plant.

2. Description of the Related Art

Renewable energy for power generation is typified by wind power generation and solar power generation. For a power plant using such renewable energy, the amount of electric power generated from renewable energy greatly varies depending on seasons, weather, and the like. Thus, this kind of power plant provided with a steam turbine needs to further reduce the time it takes for activation in order to suppress a variation in the power generation amount for stabilization of the power plant.

Since, upon the activation of the power plant, steam flowing in the steam turbine rapidly increase in temperature and flow rate, the surface of a turbine rotor rapidly increases in temperature accordingly, compared with the inside of the turbine rotor. As a result, the turbine rotor has a large temperature gradient in a radius direction thereof, followed by suffering increased thermal stress. Excessive thermal stress may reduce the life of the turbine rotor; therefore activation control need be exercised so as to prevent the increased thermal stress from exceeding a preset limit.

As this kind of activation control method, JP-2009-281248-A describes a method for activating a steam turbine at a high speed by calculating, in predictive manner, thermal stress applied for a certain period of time from the present to the future and determining an operational amount of a plant such that the thermal stress is controlled to a value equal to or lower than a limit.

SUMMARY OF THE INVENTION

Low-cycle thermal fatigue is accumulated in the turbine rotor, which is due to thermal stress generated in the turbine rotor during a cycle in which the activation of the steam turbine is stopped. If the accumulated low-cycle thermal fatigue exceeds a limit of a material of the turbine rotor, a crack may occur in the turbine rotor. This requires replacement of the turbine rotor with another rotor or the like. The low-cycle thermal fatigue accumulated in the turbine rotor during the cycle in which the activation is stopped can be defined as a reduction in the life of the turbine rotor, which is caused by the thermal stress, or a life consumption amount. The life consumption amount at the time when the crack that is due to the low-cycle thermal fatigue occurs in the turbine rotor is defined as 100%.

The limit is determined based on the aforementioned life consumption amount in general. Specifically, the limit is determined such that a life consumption amount of the turbine rotor for one time of activation, in each of activation modes of the steam turbine, does not exceed a planned life consumption amount. However, in each of the activation modes, the numbers of times of the activation for one year may be different and the life consumption amounts of the turbine rotor for one time of the activation may be different between the time at which the operation plan is created and the time at which the plant operation is performed. Since operational results of the plant are not reflected in a limit determined when the plant operational plan is created, the limit may be too small. This leads to a requirement of time necessary for activating the plant. Alternatively, there may be a case in which the limit is too large. This may causes the life consumption amount be larger than an expected value. These may result in prohibiting the plant from being activated safely at a high speed with thermal stress of the plant maintained at a level equal to or lower than the limit.

The invention has been devised under the aforementioned circumferences, and it is an object of the invention to provide a steam turbine power plant that can be safely activated at a high speed while maintaining thermal stress at a level equal to or lower than a limit based on operational results of the plant and a method for activating the steam turbine power plant.

In order to achieve the aforementioned object, according to the invention, a steam turbine power plant includes a heat source device configured to use a heat source medium to heat a low-temperature fluid and generate a high-temperature fluid, a steam generator configured to generate steam by the high-temperature fluid, a steam turbine that is driven by the steam, a power generator configured to convert driving force of the steam turbine into power, an adjuster configured to adjust a load of the plant, a measurer configured to measure a state amount of the plant, a life consumption amount calculator configured to calculate life consumption amounts of a turbine rotor included in the steam turbine based on the state amounts measured by the measurer, a life consumption amount storage device configured to store the life consumption amounts of the turbine rotor, a thermal stress limit update timing determining device configured to determine a time when thermal stress limits of the turbine rotor are updated, an accumulated life consumption amount calculator configured to accumulate, at a timing when the thermal stress limits of the turbine rotor are updated, life consumption amounts of the turbine rotor after the thermal stress limits are previously updated and calculate the accumulated life consumption amounts of the turbine rotor, a planned life consumption amount setting device configured to set, based on the accumulated life consumption amounts of the turbine rotor, planned life consumption amounts of the turbine rotor for a time period to a time when the thermal stress limits are next updated, a thermal stress limit calculator configured to calculate and update the thermal stress limits based on the planned life consumption amounts of the turbine rotor, and a plant command value calculator configured to calculate, based on the thermal stress limits, a plant command value such that the plant command value does not exceed the thermal stress limits.

According to the invention, the steam turbine power plant can be safely activated at a high speed while maintaining thermal stress at a level equal to or lower than a limit based on operational results of the plant.

BRIEF DESCRIPTION OF THE DRAWINGS

FIG. 4 is a diagram illustrating an example in which planned life consumption amounts for a current time period in each of activation modes are set by the planned life consumption amount setting device included in the steam turbine power plant according to the first embodiment of the invention.

FIG. 7 is a diagram illustrating an example in which planned life consumption amounts for the current time period in each of the activation modes are set by the planned life consumption amount setting device included in the steam turbine power plant according to the second embodiment of the invention.

FIG. 10 is a diagram illustrating an example in which planned life consumption amounts for the current time period in each of the activation modes are set by the planned life consumption amount setting device included in the steam turbine power plant according to the third embodiment of the invention.

FIG. 12 is a diagram illustrating an example in which planned life consumption amounts in one operation in each of the activation modes are set when a plant operation plan is created.

DESCRIPTION OF THE PREFERRED EMBODIMENTS

First Embodiment

Configuration

Figure 1:
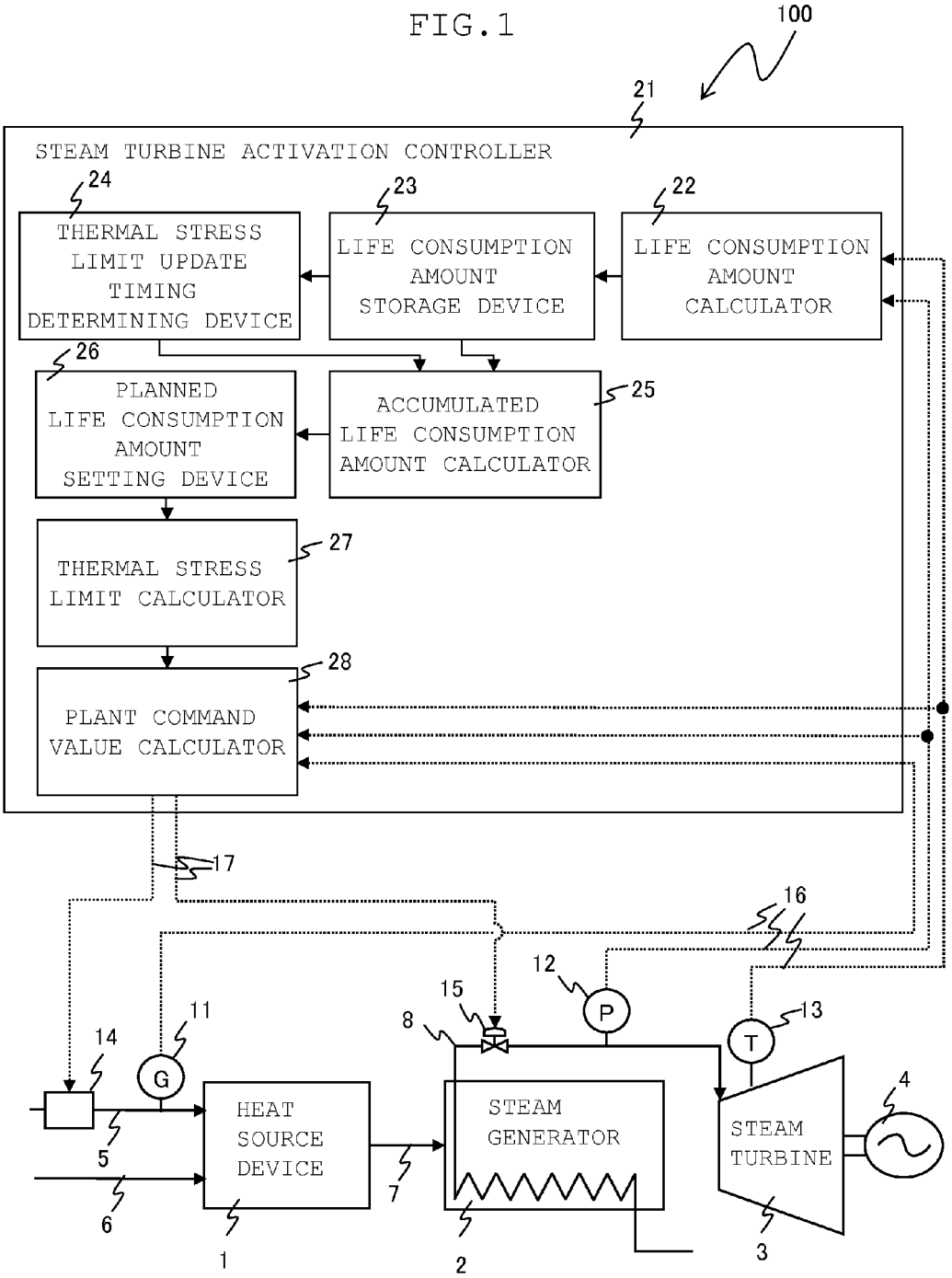
FIG. 1 is a schematic diagram illustrating a configuration of a steam turbine power plant according to a first embodiment of the invention.

FIG. 1 is a schematic diagram illustrating a configuration of a steam turbine power plant 100 according to a first embodiment of the invention. In the first embodiment, activation modes of a steam turbine are each appropriately referred to as hot start, warm start, and cold start and defined, based on a time period in an order of shorter time period during which the steam turbine is stopped after the termination of a previous operation to the start of a current operation of the steam turbine. For example, the start of the activation after a time period in which the steam turbine is stopped is shorter than a time period T1 is referred to as the hot start, the start of the activation after a time period in which the steam turbine is stopped is equal to or longer than the time period T1 and shorter than a time period T2 (>T1) is referred to as the warm start, and the start of the activation after a time period in which the steam turbine is stopped is equal to or longer than the time period T2 is referred to as the cold start (T1 and T2 are set values). In addition, the activation modes may be defined based on the temperature of metal of the steam turbine at the start time of the activation. In the first embodiment, limits set based on safety aspects regarding to thermal stress acting on parts of the steam turbine, the life of the parts, and the like are referred to as thermal stress limits.

As illustrated in FIG. 1, the steam turbine power plant 100 includes a heat source device 1, a steam generator 2, the steam turbine 3, a power generator 4, a heat source medium amount adjuster 14, a main steam adjusting valve 15, and a steam turbine activation controller 21. The first embodiment describes a case where the heat source device 1 is a gas turbine (or the steam turbine power plant is a combined cycle power plant) as an example.

The heat source device 1 uses heat held by a heat source medium 5 (a gas fuel, a liquid fuel, or a fuel such as a hydrogen-containing fuel in the first embodiment) to heat a low-temperature fluid 6 (air to be burned with the fuel in the first embodiment) and generates a high-temperature fluid 7 (combustion gas used to drive the gas turbine in the first embodiment) and supplies the generated high-temperature fluid 7 to the steam generator 2. The steam generator 2 (exhaust heat recovery boiler in the first embodiment) heats supplied water by thermal exchange with heat held by the high-temperature fluid 7 generated by the heat source device 1 and generates steam 8. The steam turbine 3 is driven by the steam 8 generated by the steam generator 2. A thermometer 13 is provided for the steam turbine 3 and measures the metal temperature of a casing or the like arranged at an initial stage of the steam turbine 3. The power generator 4 is concentrically coupled directly to the steam turbine 3 and converts driving force of the steam turbine 3 into power. The power of the power generator 4 is supplied to a power system (not illustrated), for example.

The heat source medium amount adjuster 14 (fuel adjusting valve in the first embodiment) is installed on a path for supplying the heat source medium 5 to the heat source device 1 and adjusts the amount of the heat source medium to be supplied to the heat source device 1. Specifically, the heat source medium amount adjuster 14 functions as an adjuster for adjusting a plant load of the steam turbine power plant 100 or the amount of energy to be input to the steam turbine power plant 100. In addition, on the path for supplying the heat source medium 5, a flowmeter 11 is installed on the downstream side of the heat source medium amount adjuster 14 in a direction in which the heat source medium 5 flows. The flowmeter 11 measures the amount of the heat source medium 5 to be supplied to the heat source device 1.

The main steam adjusting valve 15 is installed in a main steam pipe that connects the steam generator 2 to the steam turbine 3. The main steam adjusting valve 15 adjusts the flow rate of the steam 8 to be supplied to the steam turbine 3. Specifically, the main steam adjusting valve 15 may function as an adjuster for adjusting a plant load of the steam turbine power plant 100 or the amount of a working medium of the steam turbine 3. In addition, a pressure indicator 12 is installed on the downstream side (side of the steam turbine 3) of the main steam adjusting valve 15 in the main steam pipe in a direction in which the steam 8 flows. The pressure indicator 12 measures pressure of the steam (main steam) 8 flowing in the main steam pile.

The steam turbine activation controller 21 receives state amounts of the steam turbine power plant 100 as measured data 16 or receives various measured values representing the state amounts such as the temperatures and pressures of constituent elements of the steam turbine power plant 100, the temperature and pressure of the working medium, and the flow rate of the working medium. In the present embodiment, the supply amount of the heat source medium 5, which is measured by the flowmeter 11, the pressure of the steam 8, which is measured by the pressure indicator 12, and the metal temperature of the initial stage of the steam turbine 3, which is measured by the thermometer 13, are input as the measured data 16 to the steam turbine activation controller 21. Since values necessary to calculate thermal stress generated in the turbine rotor may vary depending on a calculation method, measured values other than the aforementioned values may be input to the steam turbine activation controller 21 as state amounts of the plant. For example, a thermometer may be installed on the downstream side (side of the steam turbine 3) of the main steam adjusting valve 15 in the direction of the flow of the steam 8 and measure the temperature of the steam 8 flowing in the main steam pipe, and the measured temperature may be input to the steam turbine activation controller 21. The steam turbine activation controller 21 outputs, based on the measured data 16, command values to be used to control the steam turbine power plant 100 as plant command values 17. In the present embodiment, the steam turbine activation controller 21 outputs, as plant command values 17, a command value to be used to adjust the heat source medium 5 to the heat source medium amount adjuster 14 and a command value to be used to adjust the amount of the steam 8 to the main steam adjusting valve 15.

The steam turbine activation controller 21 includes constituent elements such as a life consumption amount calculator 22, a life consumption amount storage device 23, a thermal stress limit update timing determining device 24, an accumulated life consumption amount calculator 25, a planned life consumption amount setting device 26, a thermal stress limit calculator 27, and a plant command value calculator 28. The constituent elements are described below.

Figure 11:
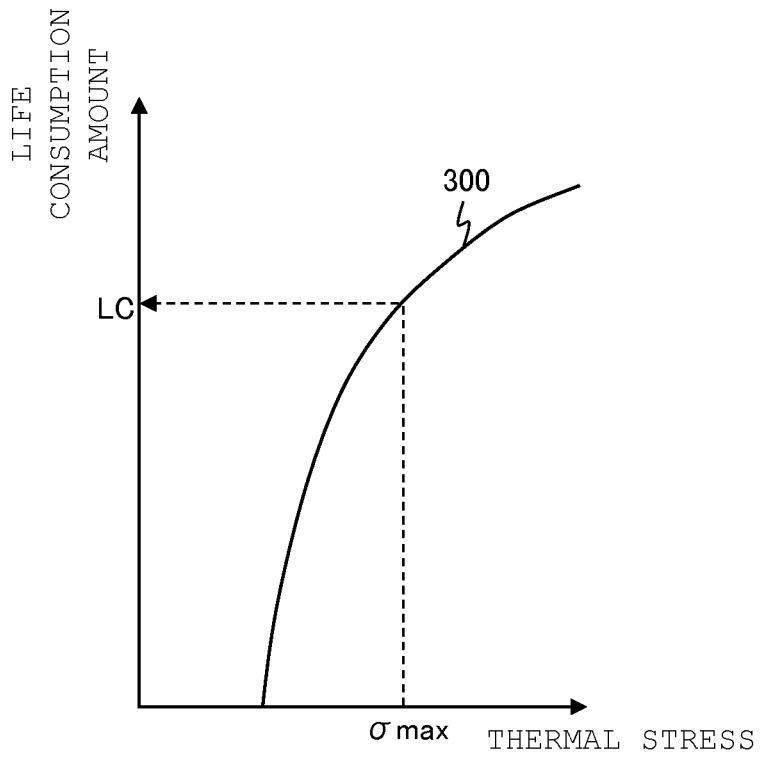
FIG. 11 is a diagram illustrating a relationship between thermal stress generated in a turbine rotor and a life consumption amount of the turbine rotor.

The life consumption amount calculator 22 calculates life consumption amounts (turbine rotor life consumption amounts) LC of the turbine rotor for one time of the activation. First, a temperature distribution in a radius direction of the turbine rotor is calculated by calculation of heat transfer to the turbine rotor based on the pressure of the steam 8 flowing in the main steam pipe, which is measured by the pressure indicator 12 and the temperature of the metal arranged at the initial stage of the steam turbine 3, which is measured by the thermometer 13. Next, thermal stress of the turbine rotor is calculated by material mechanics calculation using a linear expansion coefficient, a Young's modulus, a Poisson ratio and the like of the turbine rotor. Based on thermal stress calculated for every hour in the aforementioned manner, a peak value $\sigma max$ of the thermal stress of the turbine rotor in one activation process is calculated. The thermal stress for every hour is a thermal stress value calculated for every calculation cycle by the steam turbine activation controller 21. The life consumption amounts LC can be expressed by a function of the peak value $\sigma max$ of the thermal stress (refer to FIG. 11). FIG. 11 is a diagram illustrating a relationship between the thermal stress generated in the turbine rotor and a life consumption amount of the turbine rotor. As illustrated in FIG. 11, the life consumption amount of the turbine rotor is a function of the peak value $\sigma max$ of the thermal stress generated during one cycle from the start of the activation of the steam turbine to the stop of an operation of the steam turbine. The thermal stress of the turbine rotor is calculated at predetermined calculation intervals based on the temperature and pressure (measured data 16) of the steam flowing in the steam turbine 3, the peak value (maximum value) $\sigma max$ during the cycle from the start of the activation of the steam turbine 30 to the stop of the operation is calculated, and thus the life consumption amounts LC of the turbine rotor for one time of the activation are calculated from the function illustrated in FIG. 11. Thus, if the function of the peak value $\sigma max$ is stored in a storage region (not illustrated) of the life consumption amount calculator 22, the life consumption amounts LC can be calculated from the peak value $\sigma max$ of the thermal stress based on the function read from the storage region.

The life consumption amount storage device 23 stores, in a storage device such as a hard disk, the life consumption amounts LC of the turbine rotor for one time of the activation, which is calculated by the life consumption amount calculator 22.

The thermal stress limit update timing determining device 24 determines timings when the thermal stress limits are updated. The update timings are, for example, timings when periodic inspection is performed after a certain time period in which an operation is performed. A time period from a previous update time when the thermal stress limits are previously updated to a current update time when the thermal stress limits are updated is referred to as a previous time period, while a time period from the current update time when the thermal stress limits are updated to a next update time when the thermal stress limits are next updated is referred to as a current time period. The thermal stress limit update timing determining device 24 has a timer (not illustrated) for measuring time. For example, when a set time elapses after the previous update time, the thermal stress limit update timing determining device 24 switches the previous time period to the current time period. The present embodiment assumes that the current time period is equal to the previous time period. These time periods each include at least one cycle from the start of the activation of the steam turbine power plant 100 to the stop of an operation of the steam turbine power plant 100.

The accumulated life consumption amount calculator 25 accumulates, for each of the activation modes or for the hot start, the warm start, and the cold start respectively, a life consumption amount LC belonging to the previous time period based on the life consumption amounts LC for one time of the activation, which is stored in the life consumption amount storage device 23 at the timings determined by the thermal stress limit update timing determining device 24. The accumulated life consumption amount calculator 25 further calculates accumulated life consumption amounts (accumulated life consumption amounts of the turbine rotor) of the turbine rotor for the previous time period.

The planned life consumption amount setting device 26 estimates, based on the accumulated life consumption amounts of the turbine rotor for the previous period, the numbers of times of the activation for one year in each of the activation modes and planned life consumption amounts for the numbers of years of a plant operation in the activation modes and sets planned life consumption amounts LC0 (planned life consumption amounts of the turbine rotor) in one operation for the current time period in each of the activation modes, when a plant operation plan is created. Details of the planned life consumption amount setting device 26 are described later with reference to FIGS. 2 to 4.

The thermal stress limit calculator 27 calculates, based on the planned life consumption amount LC0 of the turbine rotor for the current time period, the thermal stress limit of the turbine rotor in each of the activation modes and updates the thermal stress limit in each of the activation modes. The thermal stress limit in each of the activation modes is determined so that the life consumption amount of the turbine rotor for one time of the activation does not exceed the planned life consumption amount or $LC \leq LC0$. Specifically, the thermal stress limit is calculated by calculating value σmax0 corresponding to the planned life consumption amount LC0 based on a thermal stress-life consumption amount curve 300 (refer to FIG. 11).

The plant command value calculator 28 determines the plant command values 17 based on the measured data 16 and outputs the plant command values 17 to the heat source medium amount adjuster 14 and the main steam adjusting valve 15 respectively. As described above, in the present embodiment, the plant command values 17 are the command value (heat source medium adjustment command value) to be used to adjust the heat source medium and the command value (main steam adjustment command value) to be used to adjust the amount of the steam 8. Operational amounts (valve opening degrees in the present embodiment) of the heat source medium amount adjuster 14 and the main steam adjusting valve 15 are adjusted by PID for example, control based on the heat source medium adjustment command value and the main steam adjustment command value, for example. The plant command value calculator 28 includes a low value selector (not illustrated). The low value selector selects smaller value which is either one of the command value calculated based on the measured data 16 and the thermal stress limit input from the thermal stress limit calculator 27, as the plant command value 17. Thus, the thermal stress of the turbine rotor is suppressed to a value equal to or lower than the thermal stress limits set by the thermal stress limit calculator 27.

Figure 2:
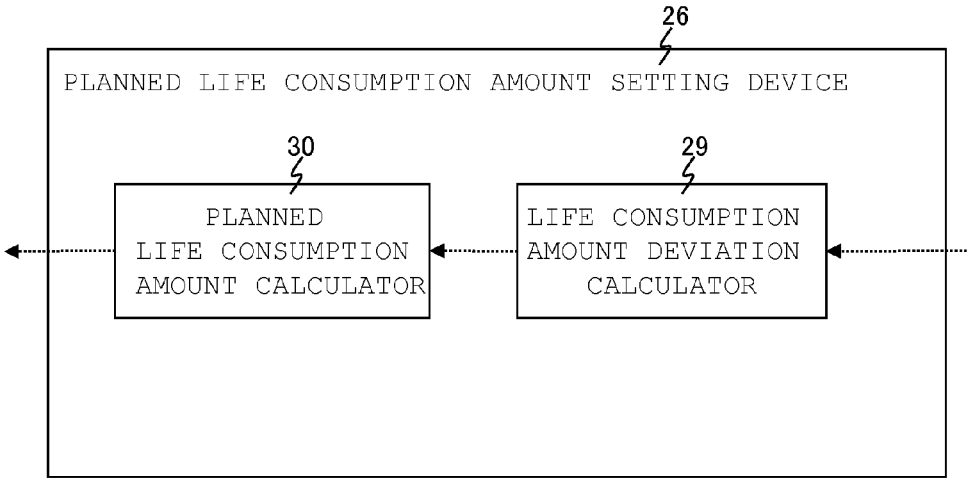
FIG. 2 is a detailed block diagram illustrating a planned life consumption amount setting device included in the steam turbine power plant according to the first embodiment of the invention.

FIG. 2 is a detailed block diagram illustrating the planned life consumption amount setting device 26.

As illustrated in FIG. 2, the planned life consumption amount setting device 26 includes a life consumption amount deviation calculator 29 and a planned life consumption amount calculator 30. The calculators 29 and 30 are described below.

The life consumption amount deviation calculator 29 calculates deviation of the life consumption amounts in each of the activation modes based on the accumulated life consumption amounts of the turbine rotor for the previous time period in each of the activation modes, which are calculated by the accumulated life consumption amount calculator 25. The deviation of the life consumption amounts is calculated by subtracting the accumulated life consumption amount from the planned life consumption amount for the previous period.

The planned life consumption amount calculator 30 calculates planned life consumption amounts for the current time period in each of the activation modes based on the deviation of the life consumption amounts. The planned life consumption amount for the current time period is calculated by adding the deviation of the life consumption amount to the planned life consumption amount for the previous time period.

Operations

Next, a procedure for updating the thermal stress limits of the steam turbine activation controller 21 is described with reference to FIG. 3.

Figure 3:
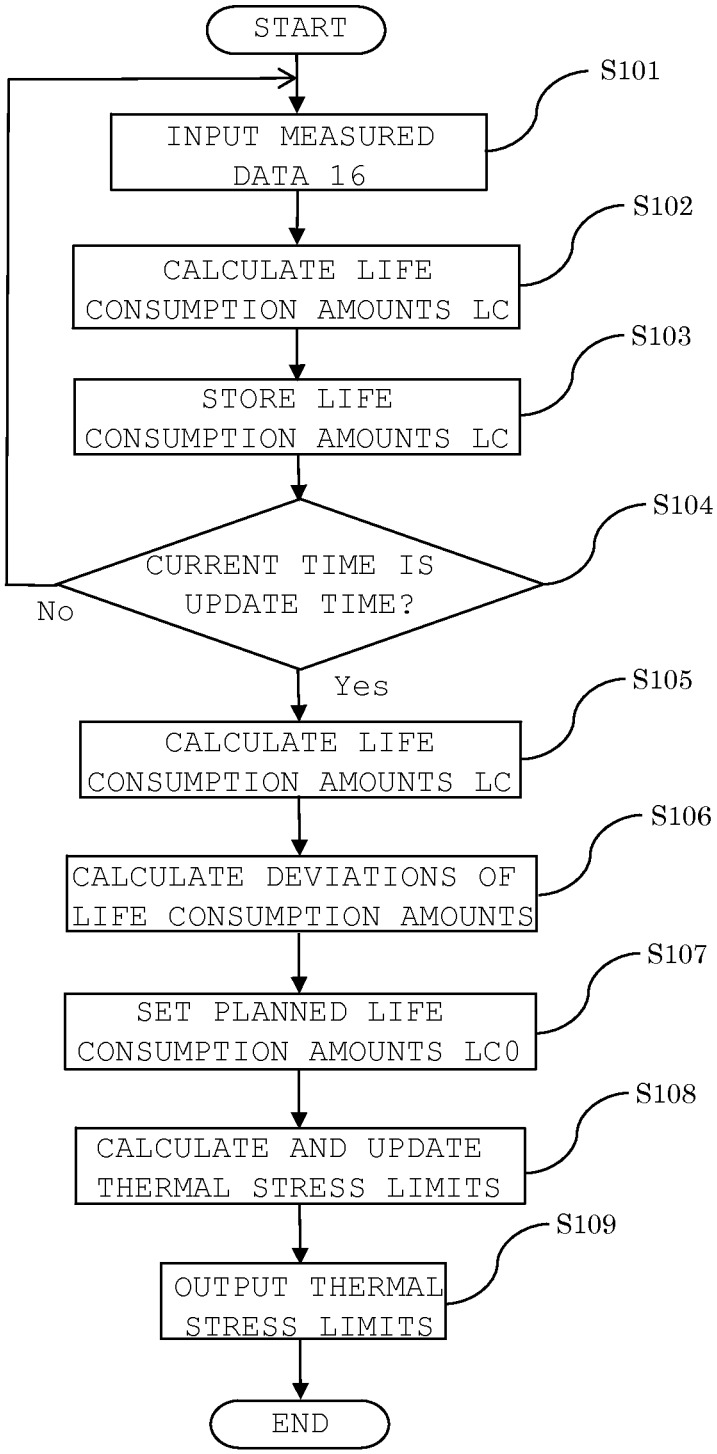
FIG. 3 is a flowchart of a procedure for updating thermal stress limits by a steam turbine activation controller included in the steam turbine power plant according to the first embodiment of the invention.

As illustrated in FIG. 3, the measured data 16 is input to the life consumption amount calculator 22 (in S101). The life consumption amount calculator 22 calculates the life consumption amount LC of the turbine rotor for one time of the activation based on the input measured data 16 (in S102) and outputs the calculated life consumption amount LC to the life consumption amount storage device 23. The life consumption amount storage device 23 stores the input life consumption amount LC of the turbine rotor for one time of the activation in the storage device such as the hard disk (in S103). The thermal stress limit update timing determining device 24 determines whether or not the current time reaches the time when the thermal stress limits are updated (in S104). If the current time reaches the time when the thermal stress limits are updated, the thermal stress limit update timing determining device 24 outputs a signal to the accumulated life consumption amount calculator 25 (in S104). If the current time does not reach the time when the thermal stress limits are updated, the procedure returns to S101 and the processes of S101 to S103 are performed again. When receiving the signal, the accumulated life consumption amount calculator 25 accumulates the life consumption amounts LC belonging to the previous time period in each of the activation modes based on the life consumption amounts LC of the turbine rotor for one time of the activation, which are stored in the life consumption amount storage device 23, and calculates the accumulated life consumption amounts of the turbine rotor for the previous time period (in S105). Then, the accumulated life consumption amount calculator 25 outputs the calculated life consumption amounts to the life consumption amount deviation calculator 29 of the planned life consumption amount setting device 26.

The life consumption amount deviation calculator 29 calculates deviations of the life consumption amounts in each of the activation modes based on the accumulated life consumption amounts of the turbine rotor for the previous time period in each of the activation modes, which are calculated by the accumulated life consumption amount calculator 25 (in S106) and outputs the calculated deviations to the planned life consumption amount calculator 30. The planned life consumption amount calculator 30 calculates planned life consumption amounts for the current time period in the activation modes (in S107) based on the deviations of the life consumption amounts and outputs the calculated planned life consumption amounts to the thermal stress limit calculator 27.

The thermal stress limit calculator 27 calculates the thermal stress limit of the turbine rotor for each of the activation modes based on the input planned life consumption amount LC0 of the turbine rotor for the current time period and updates the thermal stress limit (in S108). Then, the thermal stress limit calculator 27 outputs the thermal stress limits to the plant command value calculator 28 (in S109). Then, the procedure illustrated in FIG. 3 is terminated. The steam turbine activation controller 21 repeatedly performs the aforementioned procedure during an operation of the steam turbine power plant 100.

The plant command value calculator 28 calculates the command values based on the measured data 16 and compares the command values with the thermal stress limits received from the thermal stress limit calculator 27. The plant command value calculator 28 further outputs a smaller value which is either one of the command value and the thermal stress limit to the heat source medium amount adjuster 14, and outputs a smaller value which is either one of the command value and the thermal stress limit to the main steam adjusting valve 15.

Effects

FIG. 12 is a diagram illustrating an example of general setting of planned life consumption amounts for one operation in each of the activation modes in a plant operation plan.

The example illustrated in FIG. 12 assumes that the numbers of times of the activation for one year in the hot start, the warm start, and the cold start are 100, 15, and 2 respectively. In addition, the example illustrated in FIG. 12 assumes that planned life consumption amounts in the activation modes for 30 years of a plant operation are 35%, 35%, and 5%. Furthermore, the example illustrated in FIG. 12 assumes that the planned life consumption amounts LC0 in the activation modes are set to 0.012%, 0.078%, and 0.083%. The limits for the thermal stress to be applied upon activation control are determined so that the life consumption amounts of the turbine rotor for one time of the activation in the activation modes do not exceed 0.012%, 0.078%, and 0.083%. In this manner, the limits that are set upon the plan without consideration of operational results of the plant have been normally used for years (30 years in this case) of the plant operation.

FIG. 4 is a diagram illustrating an example in which planned consumption amounts for the current time period in each of the activation modes are set by the planned life consumption amount setting device 26.

In in FIG. 4, a second row represents the numbers 50 of times of the activation for one year, a third row represents accumulated life consumption amounts 51 for the previous time period, a fourth row represents planned life consumption amounts 52 for the previous time period, a fifth row represents planned life consumption amounts 53 for one time of the activation for the previous time period, a sixth row represents deviations 54 of the life consumption amounts for the previous time period, a seventh row represents planned life consumption amounts 55 for the current time period, and an eighth row represents planned life consumption amounts 56 for one time of the activation for the current time period. The example illustrated in FIG. 4 assumes that the time interval between the previous time period and the current time period are 2 years. The deviations 54 of the life consumption amounts for the previous time period are obtained by subtracting the accumulated life consumption amounts 51 for the previous time period from the planned life consumption amounts 52 for the previous time period. In addition, the planned life consumption amounts 55 for the previous time period are obtained by adding the deviations 54 of the life consumption amounts for the previous time period to the planned life consumption amounts 52 for the previous time period. In addition, the planned life consumption amounts 53 for one time of the activation for the previous time period are calculated by dividing the planned life consumption amounts 52 for the previous time period by the numbers of times of the activation in 2 years in each of the activation modes, while the planned life consumption amounts 56 for one time of the activation for the current time period are calculated by dividing the planned life consumption amounts 55 for the current time period by the numbers of times of the activation in 2 years in each of the activation modes.

In the example illustrated in FIG. 4, since the accumulated life consumption amounts for the previous time period are smaller than the planned life consumption amounts for the previous time period in the hot start and the warm start, the deviations of the life consumption amounts are positive and the planned life consumption amounts for the current time period are larger than the planned life consumption amounts for the previous time period. On the other hand, since the accumulated life consumption amount for the previous time period is larger than the planned life consumption amount for the previous time period in the cold start, the deviation of the life consumption amount is negative and the planned life consumption amount for the current time period is smaller than the planned life consumption amount for the previous time period. When the planned life consumption amounts 53 for one time of the activation for the previous time period are compared with the planned life consumption amounts 56 for one time of the activation for the current time period, the planned life consumption amounts 56 for one time of the activation for the current time period are larger than the planned life consumption amounts 53 for one time of the activation for the previous time period in the hot start and the warm start. If a planned life consumption amount for one time of the activation is increased, an interested thermal stress limit of the turbine rotor is increased based on the thermal stress-life consumption amount curve 300 illustrated in FIG. 11 and the plant can be activated at a higher speed. On the other hand, since the planned life consumption amount 56 for one time of the activation for the current time period is smaller than the planned life consumption amount 53 for one time of the activation for the previous time period in the cold start, and the thermal stress limit of the turbine rotor is reduced, it requires much time necessary for activating the plant. The life consumption amount in the cold start, however, can be suppressed.

As described above, in the present embodiment, if an accumulated life consumption amount obtained based on operational results is smaller than a planned life consumption amount, an interested thermal stress limit of the turbine rotor can be set to a large value by adding a deviation (serving as a margin) of the planned life consumption amount from the accumulated life consumption amount to a planned life consumption amount to be next used, and the plant can be activated at a high speed. On the other hand, if the accumulated life consumption amount is larger than the planned life consumption amount, the thermal stress limit of the turbine rotor can be set to a small value by subtracting the deviation from the planned life consumption amount to be next used, and the plant can be activated while suppressing the life consumption amount. As a result, the plant can be safely activated at a high speed while maintaining the thermal stress at a level equal to or lower than a limit in consideration of operational results of the plant.

Second Embodiment

Figure 5:
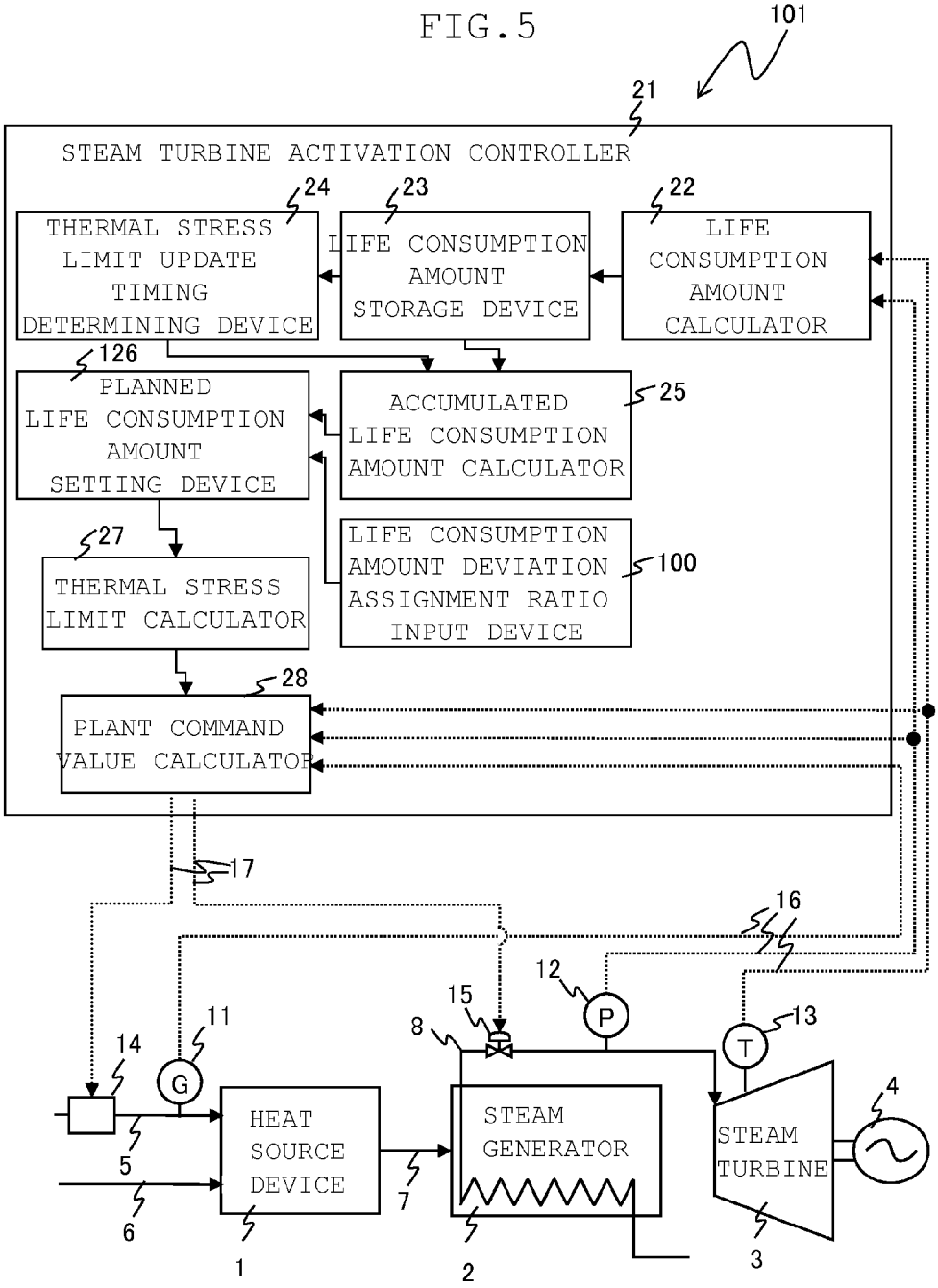
FIG. 5 is a schematic diagram illustrating a configuration of a steam turbine power plant according to a second embodiment of the invention.

FIG. 5 is a schematic diagram illustrating a configuration of a steam turbine power plant 101 according to a second embodiment. Parts that are the same as or similar to those in the first embodiment are represented by the same reference numerals as those in the first embodiment in FIG. 5, and a description thereof is omitted.

Configuration

The second embodiment is different from the first embodiment in that planned life consumption amounts for the current time period are set while the activation modes are weighted. Specifically, as illustrated in FIG. 5, the steam turbine activation controller 21 further includes a life consumption amount deviation assignment ratio input device 100. A planned life consumption amount setting device 126 receives values output from the accumulated life consumption amount calculator 25 and values output from the life consumption amount deviation assignment ratio input device 100. The life consumption amount deviation assignment ratio input device 100 and the planned life consumption amount setting device 126 are described below.

The life consumption amount deviation assignment ratio input device 100 stores an assignment ratio of deviation of life consumption amounts to each of the activation modes. The assignment ratio of the deviation of the life consumption amounts is a set value input by an operator based on an operational state or the like. The life consumption amount to be assigned to each of the activation modes is changed by the set value. Specifically, weighting for each of the activation modes can be performed by setting the assignment ratio.

Figure 6:
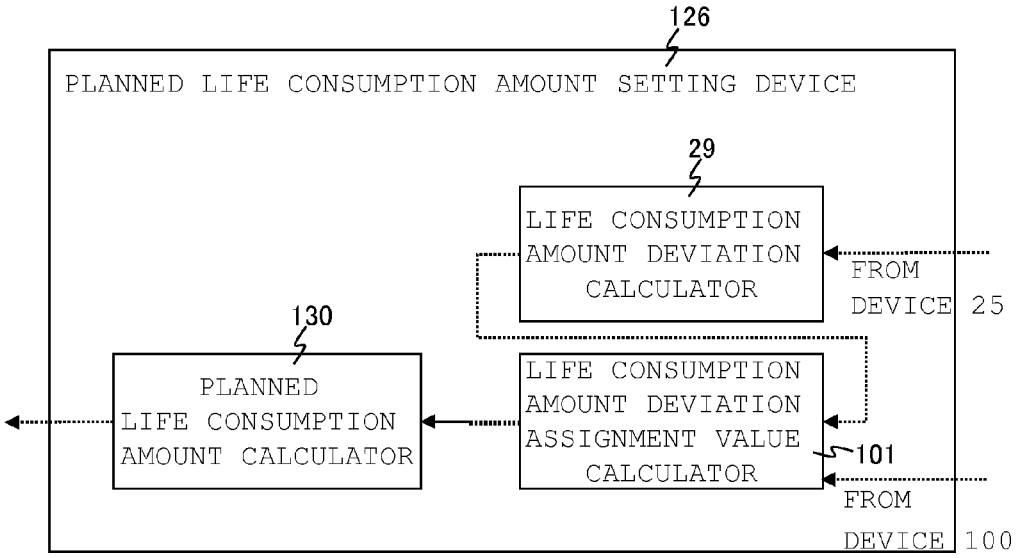
FIG. 6 is a block diagram illustrating a planned life consumption amount setting device included in the steam turbine power plant according to the second embodiment of the invention.

FIG. 6 is a block diagram illustrating the planned life consumption amount setting device 126. As illustrated in FIG. 6, the planned life consumption amount setting device 126 according to the second embodiment includes the life consumption amount deviation calculator 29, a life consumption amount deviation assignment value calculator 101 and a planned life consumption amount calculator 130. In the present embodiment, the planned life consumption amount calculator 130 calculates planned life consumption amounts for the current time period in each of the activation modes based on values output from the life consumption amount deviation assignment value calculator 101 (as described later).

Other features are the same as or similar to the first embodiment.

Operations

Next, operations of the planned life consumption amount setting device 126 are described. Details of processes other than processes to be performed by the planned life consumption amount setting device 126 are the same as or similar to those in the first embodiment.

As illustrated in FIG. 6, the life consumption amount deviation assignment value calculator 101 of the planned life consumption amount setting device 126 calculates life consumption amount deviation assignment values for each of the activation modes based on deviations of life consumption amounts for the previous time period, which are output from the planned life consumption amount calculator 29 and the assignment ratios (assignment ratios of deviation of life consumption amounts of the turbine rotor) received from the life consumption amount deviation assignment ratio input device 100. Then, the life consumption amount deviation assignment value calculator 101 outputs, to the planned life consumption amount calculator 130, the life consumption amount deviation assignment values. The deviations of the life consumption amounts in each of the activation modes are LCMG_i, the assignment ratios are ω_i, and the life consumption amount deviation assignment values are DLC_i (if i=1, i represents the hot start; if i=2, i represents the warm start; and if i=3, i represents the cold start). The life consumption amount deviation assignment values DLC_i are calculated according to the following Equations.

$$\omega_T=\omega_1+\omega_2+\omega_3 \quad \text{(Equation 160)}$$

$$LCMG_T=\mathrm{MAX}(LCMG_1,0)+\mathrm{MAX}(LCMG_2,0)+\mathrm{MAX}(LCMG_3,0) \quad \text{(Equation 161)}$$

$$DLC_i=\mathrm{MIN}(LCMG_i,0)+LCMG_T\times\omega_i/\omega_T \quad \text{(Equation 162)}$$

The planned life consumption amount calculator 130 calculates planned life consumption amounts for the current time period in each of the activation modes based on the life consumption amount deviation assignment values and the like, received from the life consumption amount deviation assignment value calculator 101. Then, the planned life consumption amount calculator 130 outputs the planned life consumption amounts to the thermal stress limit calculator 27. The planned life consumption amounts for the current time period are calculated by adding the life consumption amount deviation assignment values to the planned life consumption amounts for the previous time period.

FIG. 7 is a diagram illustrating an example of the planned life consumption amounts calculated for the current time period in each of the activation modes and set by the planed life consumption amount setting device 126.

In FIG. 7, a seventh row represents ratios 150 of assigning the deviations of the life consumption amounts to each of the activation modes, and an eighth row represents life consumption amount deviation assignment values 151. The other rows illustrated in FIG. 7 are the same as FIG. 4. The life consumption amount deviation assignment values 151 are calculated by the life consumption amount deviation assignment value calculator 101 according to Equations 160 to 162 based on the deviations 54 of the life consumption amounts for the previous time period and the ratios 150 of assigning the deviations of the life consumption amounts. In addition, the planned life consumption amounts 55 for the current time period are obtained by adding the life consumption amount deviation assignment values 151 to the planned life consumption amounts 52 for the previous time period.

In the example illustrated in FIG. 7, in order to reduce an activation time corresponding to the current time period in the warm start, the assignment ratios of deviation to the hot start, the warm start, and the cold start are 0, 1, and 0 or all the deviations of the life consumption amounts for the previous time period are assigned to the warm start for the current time period. As a result, compared with the example illustrated in FIG. 4, the planned life consumption amount 56 for one time of the activation for the current time period in the warm start is increased. Thus, the thermal stress limit of the turbine rotor in the warm start increases and the plant can be activated at a high speed. On the other hand, the planned life consumption amount 56 for one time of the activation for the current time period in the hot start is reduced, compared with the example illustrated in FIG. 4, and is equal to the planned life consumption amount 53 for one time of the activation for the previous time period in the example illustrated in FIG. 7. Thus, the thermal stress limit of the turbine rotor in the hot start is equal to the thermal stress limit of the turbine rotor for the previous time period, and an activation time of the plant in the hot start does not change.

Effects

In the second embodiment, the effects obtained in the first embodiment and the following effects can be obtained by the aforementioned configuration.

In the second embodiment, the assignment ratios of the deviation to each of the activation modes are input, and the planned life consumption amounts for the current time period are determined based on the life consumption amount deviation assignment values calculated based on the assignment ratios of the deviation. Thus, the plant can be safely activated at a high speed while providing priorities to the activation modes and maintaining the thermal stress at a level equal to or lower than a limit in consideration of operational results of the plant.

Third Embodiment

Figure 8:
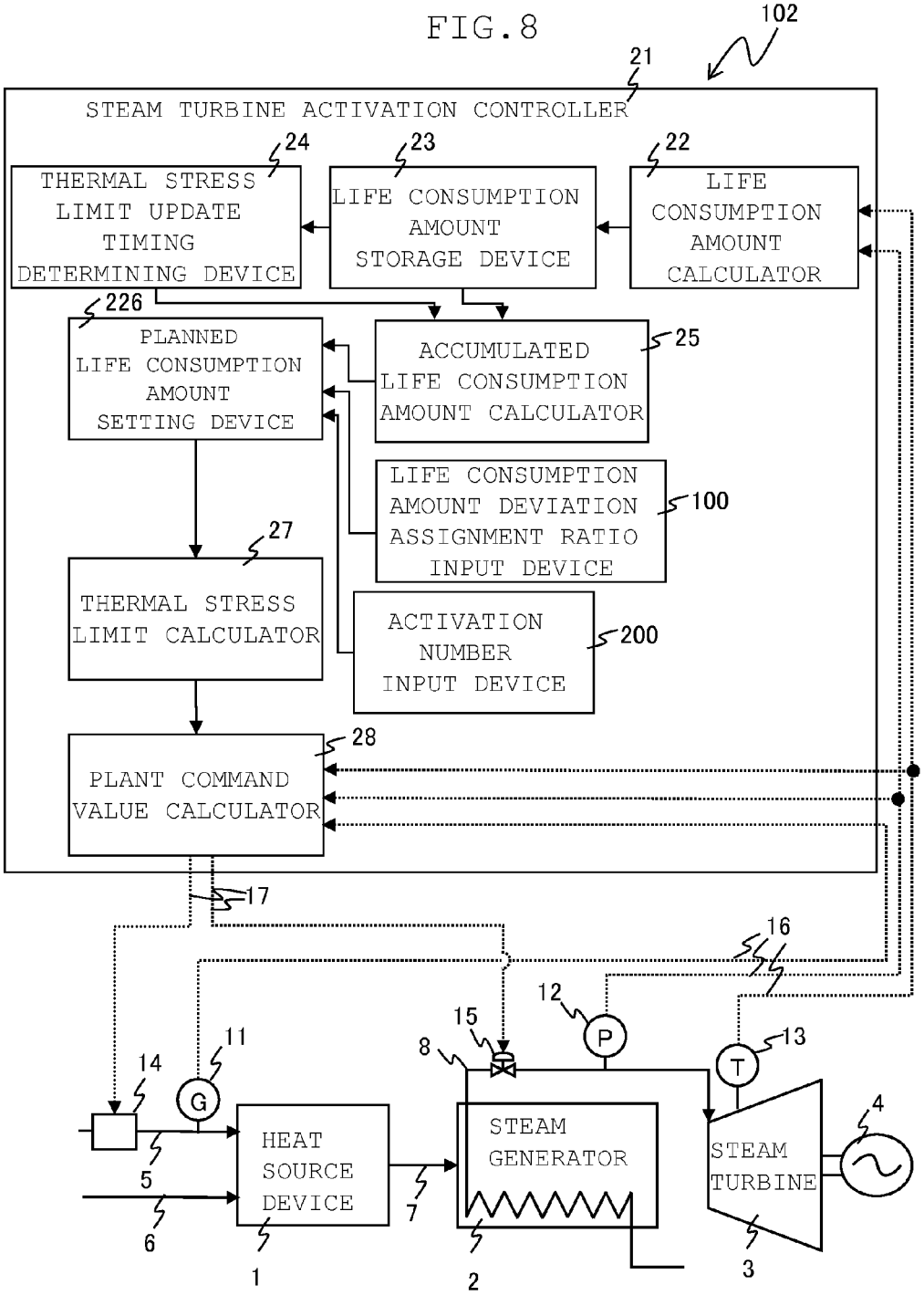
FIG. 8 is a schematic diagram illustrating a configuration of a steam turbine power plant according to a third embodiment of the invention.

FIG. 8 is a schematic diagram illustrating a steam turbine power plant 102 according to a third embodiment. Parts that are the same as or similar to those in the second embodiment are represented by the same reference numerals as those in the second embodiment in FIG. 8, and a description thereof is omitted.

Configuration

The third embodiment is different from the second embodiment in that the numbers of times of the activation per year for the current time period are identified and planned life consumption amounts for the current time period are set. Specifically, as illustrated in FIG. 8, the steam turbine activation controller 21 further includes an activation number input device 200, and a planned life consumption amount setting device 226 receives values output from the activation number input device 200 as well as from the accumulated life consumption amount calculator 25 and from the life consumption amount deviation assignment ratio input device 100. The activation number input device 200 and the planned life consumption amount setting device 226 are described below.

The activation number input device 200 stores planned number of times of the activation per year for the current time period in each of the activation modes. The numbers are values input and set by the operator.

Figure 9:
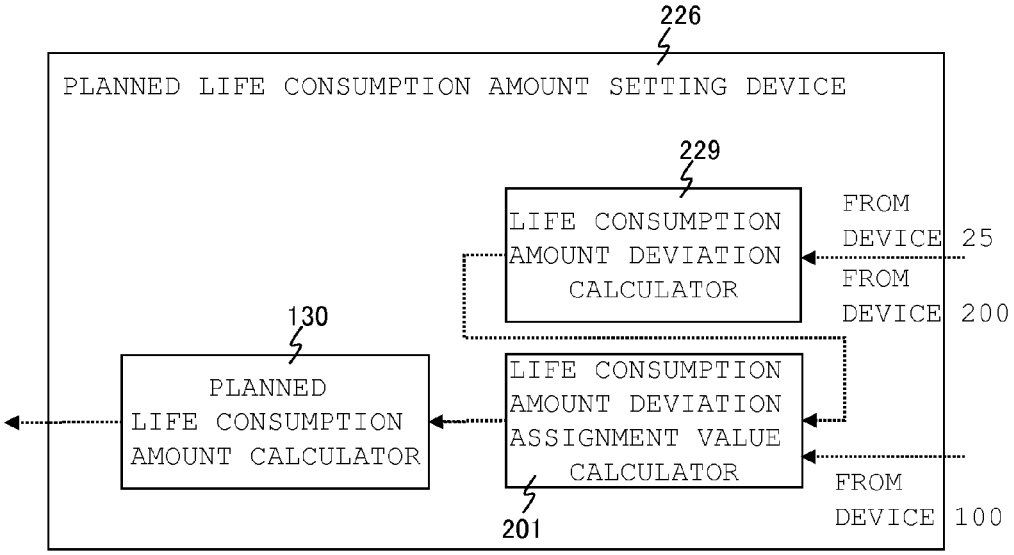
FIG. 9 is a block diagram illustrating a planned life consumption amount setting device included in the steam turbine power plant according to the third embodiment of the invention.

FIG. 9 is a block diagram illustrating the planned life consumption amount setting device 226. As illustrated in FIG. 9, the planned life consumption amount setting device 26 includes a life consumption amount deviation calculator 229, a life consumption amount deviation assignment value calculator 201, and a planned life consumption amount calculator 130. The life consumption amount deviation calculator 229 calculates deviation of life consumption amounts in each of the activation modes. The life consumption amount deviation assignment value calculator 201 calculates life consumption amount deviation assignment value to be assigned to each of the activation modes.

Other features are the same as or similar to those in the second embodiment.

Operations

Next, operations of the planned life consumption amount setting device 226 are described. Details of processes other than processes to be performed by the planned life consumption amount setting device 226 are the same as or similar to the second embodiment.

The life consumption amount deviation calculator 229 calculates deviation of the life consumption amounts in each of the activation modes based on accumulated life consumption amounts of the turbine rotor for the previous time period, which are calculated for each of the activation modes by the accumulated life consumption amount calculator 25, and on the number of times of the activation per year for the current time period in each of the activation modes, which is received from the activation number input device 200. The life consumption amount deviation calculator 229 outputs the deviations of the life consumption amounts to the life consumption amount deviation assignment value calculator 201. The deviations of the life consumption amounts for the previous time period are calculated by subtracting the accumulated life consumption amounts from the planned life consumption amounts for the previous time period. In addition, deviation LCMGS_i of the life consumption amounts is produced by the fact that the number NSC_i of times of the activation per year for the current time period is reduced to be smaller than the number NSC_i of times of the activation per year for the previous time period. The deviation LCMGS_i is calculated according to the following Equation using planned life consumption amounts LC0_i for the previous time period.

$$LCMGS_i = LC0_i \times \mathrm{MAX}(NSP_i - NSC_i, 0)/NSP_i \quad \text{(Equation 260)}$$

The life consumption amount assignment value calculator 201 calculates life consumption amount deviation assignment value to be assigned to each of the activation modes, based on the deviation, output from the life consumption amount deviation calculator 229, of the life consumption amounts for the previous time period and the assignment ratio received from the life consumption amount deviation assignment ratio input device 100. The assignment value DLC_i is calculated according to the following Equations.

$$LCMGS_T = LCMGS_1 + LCMGS_2 + LCMGS_3 \quad \text{(Equation 261)}$$

$$DLC_i = \mathrm{MIN}(LCMG_i, 0) + (LCMG_T + LCMG_T) \times \omega_i/\omega_T \quad \text{(Equation 262)}$$

In Equation 262, ω_T and LCMG_T are items calculated in Equations 160 and 161, respectively.

FIG. 10 is a diagram illustrating an example of planned life consumption amounts calculated for the current time period in each of the activation modes and set by the planned life consumption amount setting device 226.

In FIG. 10, a seventh row represents the number 250 of times of the activation per year for the current time period, an eighth row represents deviation 252 of the life consumption amounts, which is produced by reducing the number of times of the activation, and a tenth row represents life consumption amount deviation assignment value 251. Other parts are the same as those in FIG. 7.

The deviation 252 of the life consumption amounts, which is produced by reducing the number of the times of the activation, are calculated according to Equation 260 based on the number 50 of times of the activation per year for the previous time period, the number 250 of times of the activation per year for the current time period, and the planned life consumption amounts 52 for the previous time period. In addition, the life consumption amount deviation assignment value 251 is calculated according to Equations 160, 161, 261, and 262 based on the deviation 54 of the life consumption amounts for the previous time period, the deviation 252 of the life consumption amounts, which is produced by reducing the number of times of the activation, and the ratio 150 of assigning the deviation of the life consumption amounts. In addition, the planned life consumption amount 55 for the current time period is obtained by adding the life consumption amount deviation assignment value 251 to the planned life consumption amount 52 for the previous time period.

In the example illustrated in FIG. 10, the number of times of the activation per year in the hot start is changed from 100 to 80, and the number of times of the activation per year in the warm start is changed from 15 to 30. Although the life consumption amount for one time of the activation is reduced, which is due to the increase in the number of times of the activation in the warm start, the deviation of the life consumption amount for the previous time period and the deviation of the life consumption amounts, which is produced by reducing the number of times of the activation in the hot start, are assigned to the warm start for the current time period. As a result, compared with the example illustrated in FIG. 7, the planned life consumption amount 56 for one time of the activation for the current time period in the warm start further is further increased. Thus, the thermal stress limit of the turbine rotor in the warm start is increased, and the plant can be activated at a high speed.

Effects

In the third embodiment, the effects obtained in the first and second embodiments and the following effects can be obtained by the aforementioned configuration.

In the third embodiment, the deviation of the life consumption amounts, which is produced by changing the number of times of the activation per year, is reflected in the planned life consumption amounts for the current time period. Thus, the plant can be safely activated at a high speed while identifying the numbers of times of the activation per year for the current time period, providing priorities to the activation modes, and maintaining the thermal stress at a level equal to or lower than a limit in consideration of operational results of the plant.

Miscellaneous

It is to be noted that the present invention is not limited to the aforementioned embodiments, but covers various modifications. While, for illustrative purposes, those embodiments have been described specifically, the present invention is not necessarily limited to the specific forms disclosed. Thus, partial replacement is possible between the components of a certain embodiment and the components of another. Likewise, certain components can be added to or removed from the embodiments disclosed.

Each of the embodiments describes the case where the thermal stress limit update timing determining device 24 sets times when the thermal stress limits are updated to the times when the periodic inspection is performed after the certain time period in which the operation is performed. However, the essential effect of the invention is the fact that the plant is safely activated at a high speed while maintaining the thermal stress at a level equal to or lower than a limit in consideration of operational results of the plant. Thus, the times when the thermal stress limits are updated are not limited as long as the essential effect is obtained. For example, the timing at which the thermal stress limits are updated may be a timing at which an accumulated life consumption amount of the turbine rotor from the previous update timing at which the thermal stress limits are updated exceeds a set value. In addition, the times when the thermal stress limits are updated may be the times when the periodic inspection is performed after the certain time period in which the operation is performed and the times when an accumulated life consumption amount of the turbine rotor from the previous update time when the thermal stress limits are updated exceeds the set value.

In addition, each of the embodiments describes the case where the invention is applied to the combined cycle power plant as an example. The invention, however, is not limited to the combined cycle power plant and is applicable to all power plants each including a steam turbine and typified by a steam power plant and a solar power plant. In such cases, a procedure for activating the plant is the same as or similar to the procedure for activating the combined cycle power plant.

If the invention is applied to the steam power plant, coal or natural gas may be used as the heat source medium 5, air or oxygen may be used as the low-temperature fluid, a fuel adjusting valve may be used as the heat source medium adjuster 14, a furnace included in a boiler may be used as the heat source device 1, combustion gas may be used as the high-temperature fluid, and a heat transfer unit (steam generator) included in the boiler may be used as the steam generator 2.

If the invention is applied to the solar power plant, sunlight may be used as the heat source medium 5, a device for driving a heat collecting panel may be used as the heat source medium adjuster 14, the heat collecting panel may be used as the heat source device 1, and media such as oil and high-temperature solvent salt, which convert solar thermal energy and hold the converted energy, may be used as the low-temperature fluid and the high-temperature fluid.

What is claimed is:

1. A steam turbine power plant comprising:

a heat source device configured to use a heat source medium to heat a low-temperature fluid and generate a high-temperature fluid;

a steam generator configured to generate steam by the high-temperature fluid;

a steam turbine that is driven by the steam;

a power generator configured to convert driving force of the steam turbine into power;

an adjuster configured to adjust a load of the plant;

a measurer configured to measure state amounts of the plant;

a life consumption amount calculator configured to calculate life consumption amounts of a turbine rotor included in the steam turbine based on the state amounts measured by the measurer;

a life consumption amount storage device configured to store the life consumption amounts of the turbine rotor;

a thermal stress limit update timing determining device configured to determine a time when thermal stress limits of the turbine rotor are updated;

an accumulated life consumption amount calculator configured to accumulate, at a timing when the thermal stress limits of the turbine rotor are updated, life consumption amounts of the turbine rotor after the thermal stress limits are previously updated and calculate the accumulated life consumption amounts of the turbine rotor;

a planned life consumption amount setting device configured to set, based on the accumulated life consumption amounts of the turbine rotor, planned life consumption amounts of the turbine rotor for a time period to a time when the thermal stress limits are next updated;

a thermal stress limit calculator configured to calculate and update the thermal stress limits based on the planned life consumption amounts of the turbine rotor; and a plant command value calculator configured to calculate, based on the thermal stress limits, a plant command value such that the plant command value does not exceed the thermal stress limits.

2. The steam turbine power plant according to claim 1, further comprising a life consumption amount deviation assignment ratio input device configured to input assignment ratios of deviation of life consumption amounts of the turbine rotor to activation modes of the steam turbine, wherein the planned life consumption amount setting device sets, based on the assignment ratios of the deviation of the life consumption amounts and the accumulated life consumption amounts of the turbine rotor, the planned life consumption amounts for the time period to the time when the thermal stress limits are next updated.

3. The steam turbine power plant according to claim 2, further comprising an activation number input device configured to input the number of times of activation in each of the activation modes, wherein, based on the numbers of the times of the activation, the planned life consumption amount setting device sets the assignment ratios of the deviation of the life consumption amounts of the turbine rotor, the accumulated life consumption amounts of the turbine rotor, and planned life consumption amounts of the turbine rotor for the time period to the time when the thermal stress limits are next updated.

4. A method for activating a steam turbine power plant including a heat source device configured to use a heat source medium to heat a low-temperature fluid and generate a high-temperature fluid, a steam generator configured to generate steam by the high-temperature fluid, a steam turbine that is driven by the steam, a power generator configured to convert driving force of the steam turbine into power, an adjuster configured to adjust a load of the steam turbine power plant, and a measurer configured to measure state amounts of the steam turbine power plant, the method comprising:

calculating life consumption amounts of a turbine rotor included in the steam turbine based on the state amounts measured by the measurer;

storing the life consumption amounts of the turbine rotor;

determining a time when thermal stress limits of the turbine rotor are updated;

accumulating, when the thermal stress limits of the turbine rotor are updated, life consumption amounts of the turbine rotor after the thermal stress limits are previously updated and calculating the accumulated life consumption amounts of the turbine rotor;

setting, based on the accumulated life consumption amounts of the turbine rotor, planned life consumption amounts of the turbine rotor for a time period from the time when thermal stress limits of the turbine rotor are updated to a time when the thermal stress limits are next updated;

calculating and updating the thermal stress limits based on the planned life consumption amounts of the turbine rotor; and calculating, based on the thermal stress limits, a plant command value such that the plant command value does not exceed the thermal stress limits.

5. The method according to claim 4, further comprising inputting assignment ratios of deviation of the life consumption amounts of the turbine rotor to activation modes of the steam turbine, wherein the planned life consumption amounts for the time period to the time when the thermal stress limits are next updated are set based on the assignment ratios of the deviation of the life consumption amounts and the accumulated life consumption amounts of the turbine rotor.

6. The method according to claim 5, further comprising inputting the number of times of activation in each of the activation modes, wherein the planned life consumption amounts of the turbine rotor for the time period to the time when the thermal stress limits are next updated are set based on the numbers of the times of the activation, the assignment ratios of the deviation of the life consumption amounts of the turbine rotor, and the accumulated life consumption amounts of the turbine rotor.

* * * * *